US005199713A

United States Patent [19]

Kinoshita

[11] Patent Number: 5,199,713

[45] Date of Patent: Apr. 6, 1993

[54] GOLF SWING TRAINING DEVICE

[76] Inventor: Frank Kinoshita, P.O. Box 3164, Rancho Santa Fe, Calif. 92067

[21] Appl. No.: 839,331

[22] Filed: Feb. 20, 1992

[51] Int. Cl.[5] ..... A63B 69/36

[52] U.S. Cl. ..... 273/193 A; 482/109; 273/80.2

[58] Field of Search ..... 273/193 R, 193 B, 193 A, 273/194 R, 194 A, 194 B, 186.2, 187.4, 80.2; 482/109

[56] References Cited

U.S. PATENT DOCUMENTS

| | | | |
|---|---|---|---|
| 2,273,416 | 2/1942 | Norwood | 273/35 |
| 2,388,463 | 11/1945 | Benecke | 273/35 |
| 2,497,237 | 2/1950 | Reineking | 273/80 |
| 2,608,409 | 8/1952 | Pinkerton | 273/35 |
| 2,938,728 | 5/1960 | Green | 273/165 |
| 3,033,575 | 5/1962 | Hause | 273/193 |
| 3,111,322 | 11/1963 | English | 273/183 |
| 3,351,346 | 11/1967 | Strahan | 273/193 |
| 3,462,156 | 8/1969 | Gentry | 273/186 |
| 3,533,630 | 10/1970 | Monaco | 273/165 |
| 3,575,419 | 4/1971 | Davis | 273/186 |
| 3,716,239 | 2/1973 | Goudreau | 273/194 |
| 3,975,024 | 8/1976 | Stephan | 273/193 |
| 4,511,147 | 4/1985 | Olsen | 273/193 |
| 4,521,023 | 6/1985 | Williams | 273/183 |
| 4,529,204 | 7/1985 | Yamakawa | 273/193 |
| 4,614,343 | 9/1986 | Radway | 273/186 |
| 4,754,978 | 7/1988 | Dworacek | 273/193 |
| 4,854,585 | 8/1989 | Koch | 273/193 |
| 5,121,925 | 6/1992 | Blundo | 273/193 A |

OTHER PUBLICATIONS

"Golf Magazine", Jun. 1991, pp. 97–104.

*Primary Examiner*—George J. Marlo

[57] ABSTRACT

This invention relates in general to a category of golf equipment and in particular to two golf swing training devices. The two golf swing training devices are primarily used to accelerate the development of the golfer's, particularly the wrist, muscles required to properly perform the golf swing. The first swing training device is a uniquely weighted device bearing some resemblance to an iron golf club. The second golf training device is a weighted attachment which is readily and quickly attached to the club head toe of a golf club. Both of these swing training devices simulate a golf club exhibiting very high axial moment of inertia. Since these swing training devices afford very high axial moment of inertia, rapid development and stimulation of the right wrist pronator and left wrist supinator muscles will be realized by the golfer. The delayed hit which is essential to any good golf swing places stringent demands on the golfer's wrist muscles just prior to impact. The attachment of the second golf swing training device to the golf club head is facilitated through use of a single or a plurality of leads wherein said leads are an integral part of the second training device.

6 Claims, 2 Drawing Sheets

GOLF SWING TRAINING DEVICE

FIELD OF THE INVENTION

The present invention relates in general to a category of golf equipment and in particular to two types of golf swing training devices.

BACKGROUND OF THE INVENTION

A dictum of golf technique is that the club face should remain parallel to and on the swing plane except near the impact point if the desired delayed hit is to be achieved. This preceding dictum means that the golfer must rapidly rotate the club shaft 90 degrees about its longitudinal axis in approximately 58 milliseconds just prior to impact given a club head velocity of 75 MPH. The delayed hit which is essential to a good golf swing requires the golfer to : (a) maintain a cocked wrist position until approximately the last 90 degrees of swing arc just prior to impact, (b) while in this cocked wrist position, the club face must be parallel to and on the swing plane, (c) and then in approximately 58 milliseconds, just prior to impact, rotate the club shaft so that the club face is perpendicular to the swing plane. The center of gravity of the club head which is approximately at the mid-point of the club head between the heel and toe extremities must be moved off of the swing plane by rotating the club shaft 90 degrees about its longitudinal axis in 58 milliseconds. The rotation of the club shaft is accomplished by the use of the golfer's pronator and supinator wrist muscles. The club head center of gravity, is experiencing high centrifugal forces during this critical 90 degrees (last arc segment before impact) of the swing arc.

Centrifugal force can be defined as, $a_n = v^2/r$. If we let $r = 4.04$ feet and $v = 110$ feet/second (75 MPH), we are looking at a centrifugal force of approximately 93 Gs. Due to the movement of the pivot point during the golf swing, it is expected that the G force would be considerably less than 93, but even with a G force of 50, the golfer is compelled to rotate the club shaft 90 degrees about its longitudinal axis in 58 milliseconds against this high G force which is resisting any reaction to move the club head center of gravity off of the swing plane. It is the wrist muscles, mainly the left wrist supinator muscle and the right wrist pronator muscle, that provides the reaction to rotate the club shaft about its longitudinal axis. An authority states that: "Every good golfer has his left wrist in this supinating position at impact." [Ben Hogan in *Five Lessons The Modern Fundamentals Of Golf*, pp 101, 102; A Fireside Book, Simon & Schuster, Inc. New York Copyright 1957 by Ben Hogan]. It is important to note that the authority Ben Hogan pages 101 and 103 strongly advises against pronation of a golfer's left wrist just before impact.

It is the intent of this invention's golf swing trainer to enhance the development of the golfer's left wrist supinator muscle and right wrist pronator muscle and the other muscles required to perform a good golf swing. The pronator muscle is defined as the right wrist muscle required to rotate the club shaft counterclockwise (for a right handed golfer) about its longitudinal axis, just prior to impact. The supinator muscle is defined as the left wrist muscle required to rotate the club shaft counterclockwise about its longitudinal axis, just prior to impact. Hereinafter, the pronator and supinator muscles maybe referred to as the delayed hit muscles. The delayed hit has already been defined as a special case condition existing through the last 90 degrees of the swing arc just prior to impact. Hence, there is a need for the golfer to develop his delayed hit muscles if he is to consistently achieve the delayed hit which is so essential to a good golf swing.

OBJECT OF THE INVENTION

To provide a golf swing training device that enhanced and accelerates the development of the golfer's delayed hit and other muscles required in the performance of a delayed hit golf swing.

To provide a golf swing training device that can be used by the golfer in between shots during the course of playing a round of golf wherein his practice swings will serve as a reminder of the importance of the delayed hit. Toward this end, the present invention's training device incorporates a standard grip and a straight shaft so that said training device conveniently fits into an ordinary golf bag tube.

To provide a golf swing training device wherein its swing weight does not depart too greatly from the golfer's accustomed swing weight. A correlation of swing weights between this training device and the golf club normally used by the golfer ensures that the golfer is not faced with two entirely different swing weight situations during his practice swing and actual golf swing. Using a trainer, in between golf shots, that has a large departure from the golfer's accustomed swing weight may well be detrimental to the golfer.

To provide a golf swing training device affording a very high axial moment of inertia. The golf swing training device of the present invention is configured to provide the maximum available axial moment of inertia consistent with its swing weight and form factor constraints. The training device head form factor is constrained to be approximately 4.0 inches along its longitudinal axis and 2 inches in height. The training device head bear some resemblance to an iron golf club head.

To provide a very high axial moment of inertia training device by ensuring that the toe weighted mass section is devoid of any holes to maximizes the air resistance presented by said mass sections during practice swings taken by the golfer. When using the training device of the present invention, the golfer will be forced to use his pronator and supinator muscles to overcome the additional torque generated by the air resistance.

To provide a training device that affords the maximum practical available axial moment of inertia about its longitudinal axis consistent with its weight and form factor by ensuring that the hosel and the interconnect between the hosel and toe mass section are configured to provide a low weight structure.

To provide a training device that is suitable for either a right or left handed golfer.

To provide a training device that is simple and economical to produce.

Some of the general objectives of the present invention is summarized as: to provide a golf swing training device that is uniquely structured and weighted so that it affords, a high axial moment of inertia training device, a swing weight that is consistent with the swing weight of an ordinary golf club, a high air resistance toe mass section to further enhance the delayed hit muscle development of the golfer, adjustability of the swing weight to accommodate the special needs of a golfer, utility so that either a right or left handed golfer is allowed to use said training device, a form factor bearing some resemblance to an iron golf club, and a configuration which allows said training device to conveniently fit into an ordinary golf bag tube so that it may be conveniently carried by a golfer while playing a round of golf.

To provide a golf swing training device comprised of a weighted implement configured to be attached to the toe extremity of a conventional golf club. Said weighted implement in combination with a conventional golf club becomes a trainer that enhances and accelerates the development of the golfer's delayed hit and other muscles required in the performance of the delayed hit golf swing.

To provide a configuration of said weighted implemented so that at least 75 percent of its weight is concentrated at the toe extremity of the conventional golf club. The concentration of weight location affords, in combination with the conventional golf club, a high axial moment of inertia golf swing trainer.

To provide said weighted implement with attachment means to readily attach or detach said weighted implement to or from a conventional golf club so that said weighted implement may be conveniently used by the golfer during a round of golf.

Prior art does not provide a golf swing training device that provides: a high axial moment of inertia (consistent with its weight), a structure that increases the axial moment of inertia due to air resistance created during a swing, a swing weight that is consistent with swing weights used by most golfers, a weight that is consistent with the weight of a golf club that is used by most golfers, adjustability of the training device swing weight to accommodate the special needs of a particular golfer, broad utility (may be used as a two-handed training device by either left or right handed golfers, and will fit into a standard golf bag tube), and economical construction.

In an embodiment of the present invention, the golf swing training device is comprised of a grip, a shaft, and a trainer head somewhat resembling a golf club head except that the trainer head lacks a ball striking face since the trainer head is not designed to strike a golf ball. This training device contains a concentration of weight at the opposite end of the hosel. The opposite end of hosel will be referred to as the toe end or toe extremity, wherein the hosel is the part that interfits with a shaft. The concentration of weight at the toe end of the training device head affords a high axial moment of inertia device. High axial moment of inertia is defined for the present invention as high rotational moment of inertia about the shaft longitudinal axis and is related to high torque about the shaft longitudinal axis. Because of its high axial moment of inertia, said training device will particularly enhance the development of the golfer's delayed hit muscles.

In a preferred embodiment of the present invention, the training device will provide a fixed swing weight of approximately F-0 on a prorhythmic swing weight scale. A typical swing weight of an ordinary golf club is approximately D-0 on this prorhythmic swing weight scale. This preferred embodiment of the training device has a swing weight of approximately 20 points above said ordinary golf club. This increase in swing weight, D-0 to F-0, will not appreciably affect the swing velocity of the golf swing. One intention of this invention is to provide a golf swing training device that enhances the development of the delayed hit muscles of the golfer but not at a sacrifice to the development of the golfer's other, including speed, muscles.

In another preferred embodiment of the present invention, the concentration of the weight at the toe end shall be adjustable to accommodate the particular needs of a golfer. The adjustability of the weight will accommodate the golfer's degree of muscle development and/or other special needs. If said training device is adjusted to equal the swing weight that the golfer normally uses, his golf swing velocity will not be affected, by a noticeable extra demand will be placed on the golfer's delayed hit muscles in the critical (delayed hit) zone because of the high axial moment of inertia uniquely afforded by the present invention's training device. Of course, additional weighting over and beyond the golfer's normal swing weight may be used to further enhance the development of the golfer's delayed hit and other muscles required for a delayed hit golf swing. The delayed hit is essential to any good golf swing.

The fundamental and unique concept of the present invention is to provide a golf swing training device that enhances the development of the so essential delayed hit muscles without sacrificing the development of the golfer's speed or other muscles required in the performance of a good solid golf swing. It is well known that club head velocity (speed) is required to obtain distance. Said concept of the present invention is realized by providing a high axial moment of inertia training device, but wherein the swing weight and weight of said training device is consistent with the golfer's accustomed swing weight and golf club weight.

SUMMARY OF THE INVENTION

To provide a golf swing training device that is uniquely structured and weighted so that is affords, a high axial moment of inertia training device, a swing weight that is consistent with a swing weight of an ordinary golf club, a high air resistance toe mass section to further enhance the delayed hit muscle development of the golfer, adjustability of the swing weight to accommodate the special needs of a golfer, utility so that either a right or left handed golfer is allowed to use said training device, a form factor bearing some resemblance to an iron golf club, and a configuration which allows said training device to conveniently fit into an ordinary golf bag tube so that it may be conveniently carried by a golfer during a round of golf.

This training device is approximately 38 inches long which is substantially the length of a number four iron golf club. This training device may be carried by the golfer during a round of golf to stimulate his delayed hit muscles in between golf shots. This method of use will serve as a mental reminder, to the golfer, as to the importance of the delayed hit. The delayed hit muscles are defined as the muscles required to very rapidly rotate the golf club shaft about its longitudinal axis just prior to impact. Said delayed hit muscles involve the right wrist pronator and left wrist supinator muscles. To achieve the so essential delayed hit, the golfer must rotate the golf shaft 90 degrees about its longitudinal axis in approximately 58 milliseconds given a club head velocity of 75 MPH. If a golfer is to achieve even a modicum of success, it is imperative that the golfer develops his delayed hit muscles.

The *GOLF* magazine, June 1991, "The Iron Men", pages 97 through 103 illustrates golf swings by three well known golf professionals. And in particular, bottom of pages 99, 101 and 103 illustrates the positions of their wrists (hands) through the critical swing arc segment (delayed hit zone) just before impact. It is clear from these illustrations that all three golf professionals have rotated their wrists (hands) approximately 90 degrees about the club shaft longitudinal axis in the critical delayed hit zone to obtain their desired results. It is clear from these illustrations that it is imperative for the golfer to develop his delayed hit muscles.

One golf swing training device of the present invention is a uniquely structured weighted (adjustable or fixed) device comprised of a grip, a shaft, and a training device head bearing some resemblance to an iron golf club except that it lacks a ball striking surface. This training device is not designed to strike a golf ball. To enhance the development of the delayed hit muscles, the present invention's training device simulates a golf club which exhibits high axial moment of inertia about its longitudinal axis. This feature is obtained by extensive toe weighting of the training device head. In one preferred embodiment, said extensive toe weighting is adjustable and may be tailored to the meet the needs of the golfer.

Another type of golf swing training device is a weighted implement which is readily attachable to the toe extremity of a conventional golf club. Said weighted implement may be left attached to the toe extremity of a conventional golf club during muscle development training sessions. For practice swings during a round of golf, the golfer attaches this weighted implement to the toe of the club which he intends to use on his next shot, takes a couple of practice swings, detaches this weighted implement and proceeds with his play. Attaching this weighted implement to the toe extremity dramatically increases the axial moment of inertia of the golf club, but at only a small increase in golf club swing weight, since substantially all of the weight of this weighted implement is attached to the toe extremity. Said weighted implement is configured to be usable on most golf club ranging from the driver to the number nine iron.

Using the high axial moment of inertia training devices of the present invention, the golfer will rapidly develop his delayed hit and other golf swing muscles. Additionally, use of these training devices between golf shots on the course will stimulate the delayed hit muscles and reminds the golfer of the importance of the delayed hit golf swing.

The unique features of the golf equipment that are considered characteristic of the present invention are set forth in the appended claims. The invention will readily be understood from the following description when read in connection with the accompanying drawings.

DESCRIPTION OF PREFERRED EMBODIMENTS

Figure 1:
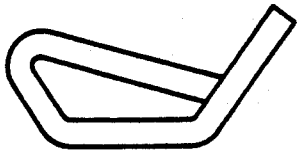
FIG 1 PRIOR ART
FIGS. 1 and 2 are frontal views of two prior art golf training clubs.

FIG. 1 is frontal view of a prior art (U.S. Pat. No. 4,511,147) golf swing training club. This prior art golf swing training club features a head made from bent bar stock and formed to provide an open head to minimize the air resistance. The present invention's training device describes and claims features diametrically opposed to this prior art. The present invention's training device specifics a mass section surface area of at least 2 square inches to provide air resistance so that the golfer will be compelled to use his pronator and supinator muscles (delayed hit muscles) to overcome the additional torque generated by the air resistance created by its mass section's surface area. This additional torque experienced by the golfer will enhance and accelerate the development of his delayed hit muscles.

Figure 2:
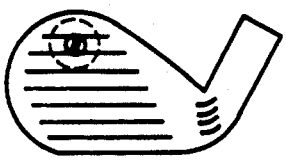
FIG 2 PRIOR ART

FIG. 2 is frontal view of a prior art (U.S. Pat. No. 4,529,204) training club for golfers. This prior art training club for golfers features a short pitching wedge shaft and a hand grip adapted to be grasped by one hand. The present invention's training device is preferably 38 inches long and features a standard two-handed grip. A standard pitching wedge is only 35.5 inches long. The purpose of the present invention's training device, is in part, to enhance the development of the golfer's right wrist pronator and left wrist supinator muscles (delayed hit muscles). Simultaneous development of the right wrist pronator and left wrist supinator muscles is not possible with only one hand grasping the training device. This prior art training club for golfers illustrates an adjustment means of its swing weight, but does not specify the location of this adjustment means relative to its shaft longitudinal axis. Therefore, it could be deduced that Yamakawa is not concerned with providing a trainer that exhibits high axial moment of inertia. The golf swing training device of the present invention is configured to provide the maximum available axial moment of inertia consistent with its swing weight and form factor constraints. The present invention specifies and claims that the weighted mass center of gravity is located at least 2.5 inches from its shaft longitudinal axis affording a high axial moment of inertia training device.

Figure 3:
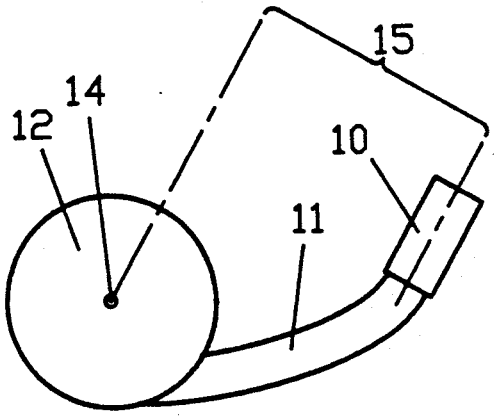
FIG. 3 is a frontal view of the fixed swing weight head of the present invention's golf swing training device.

FIG. 3 is a frontal view of the fixed swing weight head of the present invention's golf swing training device. Said fixed swing weight head is comprised of a low weight hosel 10, a low weight interconnect 11, and a substantial mass section 12. The location of the mass section 12 center of gravity 14 relative to the hosel centerline is shown by dimension 15. In one preferred embodiment, the weight of the hosel 10 and interconnect 11 is two ounces and the weight of the mass section 12 is seven ounces. This head weight of nine ounces combined with a light-weight steel shaft, cut for a training device length of 38 inches, and a standard grip will afford a swing weight of approximately D-3 on a prorhythmic swing weight scale. This preferred embodiment meets the present invention's intent to provide a high axial moment of inertia training device consistent with ordinary swing weight and training device head form factor constraints. Said training device head form factor is constrained to be approximately 4.0 inches in length, measured along its longitudinal axis, with a height dimension of approximately 2.0 inches. A D-3 swing weight is consistent with a swing weight used by many golfers. Because the dimension 15 is specified to be at least 2.5 inches, this preferred embodiment of the present invention will afford a high axial moment of inertia device with a torque about its shaft axis of more than 17.5 in-oz.

The frontal surface area of the mass section 12 is specified to be at least 2.0 square inches. This surface area creates additional torque for the golfer to overcome during practice swings because of its air resistance. When using the training device of the present invention, the golfer will be forced to use his pronator and supinator muscles (delayed hit muscles) to overcome the additional torque generated by the air resistance of the mass section 12. This additional torque is over and beyond the torque generated by the unique structure of the present invention's high axial moment of inertia training device. The static torque of 17.5 in-oz becomes magnified in a dynamic situation involving high centrifugal forces. The golfer is compelled to rotate the club shaft against the effects of high centrifugal and air resistance forces and will quickly develop his delayed hit and other swing muscle by using the training device of the present invention.

Figure 4:
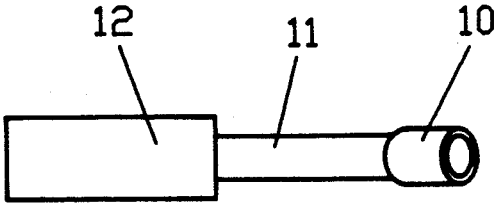
FIG. 4 is a top view of the fixed swing weight head of the present invention's golf swing training device.

FIG. 4 is a top view of the fixed swing weight head of the present invention's golf swing training device. This view also shows the interconnect 11 to be rather thin so that the weight of this interconnect is minimized. A highly rigid massive interconnect is not necessary since the training device is not intended to be used for striking a golf ball. Moreover, it is the intent of the present invention to provide a high moment of inertia training device by concentrating the available weight far away as practical from its hosel. It is not critical as to the type of materials used for the the present invention's training device but should preferably be of one piece economical construction.

Figure 5:
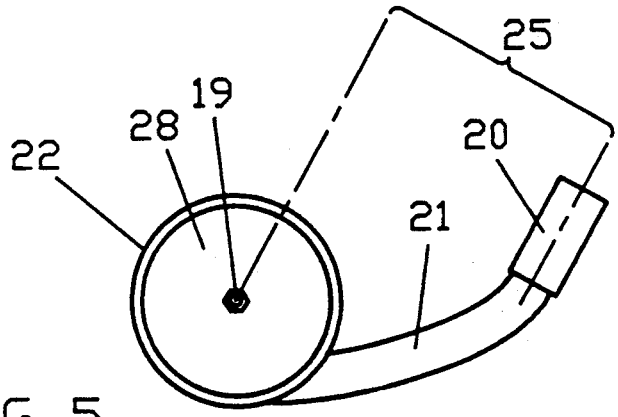
FIG. 5 is a frontal view of the adjustable swing weight head of the present invention's golf swing training device.
Figure 6:
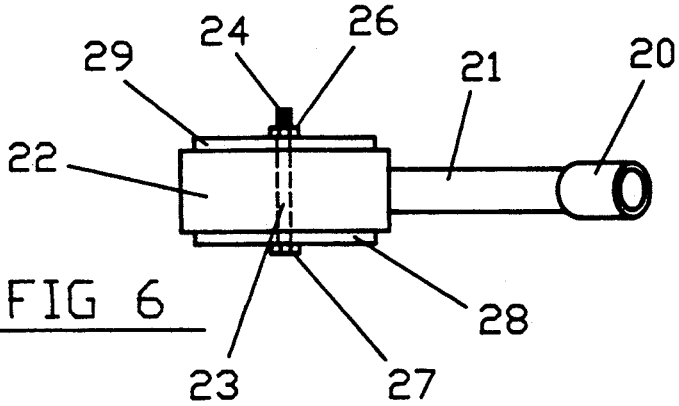
FIG. 6 is a top view of the adjustable swing weight head of the present invention's golf swing training device.

FIG. 5 is a frontal view of the adjustable swing weight head of the present invention's golf swing training device. FIG. 6 is a top view of the adjustable swing weight head of the present invention's golf swing training device. Said adjustable swing weight head is comprised of a low weight hosel 20, a low weight interconnect 21, and a substantial mass section 22. This mass section 22 has an axial borethrough hole 23 to accommodate a bolt shaft 24. A bolt comprised of a head 27, a shaft 24, and nut 26 is used to mount additional weights, 28 and 29, to the mass section 22 to suit the needs of then golfer. These additional weights are made of tungsten steel, stainless steel, or any other suitable weighting materials. For the sake of brevity, locking or captive hardware is not discussed or shown. The location of the mass section 22 center of gravity 19 relative to the hosel centerline is shown by dimension 25. In one preferred embodiment, the combined weight of the hosel 20 and interconnect 21 is approximately two ounces and the weight of the mass section 22, not including any additional weights, is approximately 6.0 ounces. This mass section of 6 ounces should accommodate even the weakest of golfers.

This preferred embodiment meets the present invention's intent to provide a high axial moment of inertia training device consistent with swing weights commonly used and form factor constraints. Since the dimension 25 is specified to be at least 2.5 inches, this preferred embodiment of the present invention, without any additional weights, will afford a high axial moment of inertia device affording a torque of more than 15.0 in-oz about its hosel centerline. If additional weights were used to bring the combined mass section weight up to 8 ounces, then the torque about its hosel centerline would be 20.0 in-oz. The frontal surface area of the mass section 22 is specified to be at least 2.0 square inches. This surface area creates additional torque for the golfer to overcome during practice swings because of the air resistance generated by said surface area. When using the training device of the present invention, the golfer will be forced to use his pronator and supinator muscles (delayed hit muscles) to overcome the additional torque generated by the air resistance of the mass section 12. This additional torque is over and beyond the torque generated by the unique structure of the present invention's high axial moment of inertia training device. The static torque of 20.0 in-oz becomes magnified in a dynamic situation involving high centrifugal forces. The golfer is compelled to rotate the club shaft against the effects of high centrifugal and air resistance forces and will; therefore, quickly develop his delayed hit and other swing muscle by using the training device of the present invention.

Figure 7:
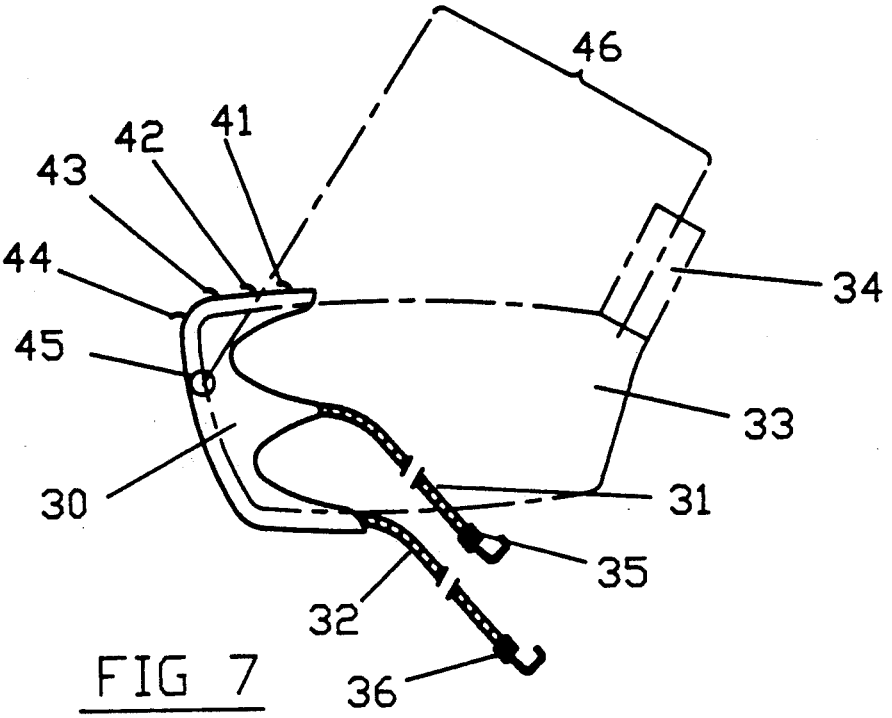
FIG. 7 is a frontal view of the weighted implement of the present invention's golf swing training device. Said weighted implement is uniquely positioned over the toe extremity of a conventional wood type golf club.

FIG. 7 is a frontal view of the weighted implement of the present invention's golf swing training device. Said weighted implement is uniquely positioned over the toe extremity of a conventional wood type golf club 33. The toe extremity being the part a golf club head that is the farthest from the golfer as he takes his stance. In regards to weighted trainer attachments, prior art puts the attachment around the shaft of the golf club to increase the golf club swing weight. In this embodiment of the present invention, this weighted implement is comprised of two cords affording means to readily attach this weighted implement to a conventional golf club head. This weighted implement is designed to be readily carried by the golfer during the course of playing a round of golf. The golfer simply attaches this weighted implement to one of his golf clubs, preferably the club he intends to use on his next shot, and then takes a few practice swings to stimulate his delayed hit muscles. Additionally and importantly, practice swings with this weighted element will serve as a mental reminder to the golfer, of the importance of the delayed hit. Since this weighted implement is attached to the toe extremity, the golf club becomes a high axial moment of inertia training device.

In this preferred embodiment, said weighted implement will increase the swing weight of a driver club by approximately twenty points on the prorhythmic swing weight scale. In other words, a driver club with a swing weight of D-0 will become a F-0 swing weight club after the weighted implement is attached to its club head. Said weighted implement may be left attached to a golf club during training periods to enhance the development of the golfer's delayed hit muscles and other muscles required to perform a delayed hit golf swing. This increase of twenty points on the prorhythmic swing weight scale will not appreciably affect the swing velocity of the golfer's swing. The prior art weighting device (U.S. Pat. No. 3,716,239) modifies a golf club swing weight to a point where the swing weight can not be measured on a standard prorhythmic swing weight scale.

In regards to this embodiment of the present invention's weighted implement, the fundamental and unique concept is to provide a training device that affords high axial moment of inertia but without unduly increasing the swing weight of the golf club. This embodiment does not simply add weight around the shaft of the golf club to increase the golf club's swing weight but uniquely locates the weighted implement at the toe extremity of the club head to increase the axial moment of inertia of the golf club. The intent is to provide a training device wherein its swing weight does not depart too greatly from the golfer's accustomed swing weight yet places extra demands on the golfer's delayed hit muscles. A similarity of swing weights between this training device and the golf club normally used by the golfer ensures that the golfer is not faced with two entirely different swing weight situations during his practice swing and actual golf swing. Using a trainer, in between golf shots, that has a large difference in swing weights, between the trainer and the golf club, may well prove to be detrimental.

Referring to FIG. 7, the weighted implement body is secured to the club head, in this preferred embodiment, by using the attachment cords 31 and 32. These cords 31 and 32 are terminated with spring biased hooks 35 and 36. These cords 31 and 32 are sufficiently long to be wrapped around the hosel 34 two times and then return to the weighted implement body 30. Hooks 35 and 36 are used to attach the free end of the cords to hook receptacle 37 through 44. Hook 35 will be attached to either hook receptacle 37, 38, 39, or 40. Hook 36 will be attached to hook receptacle 41, 42, 43, or 44. The center of gravity 45 of the weighted implement body 30 location relative to the hosel centerline is shown by dimension 46. The inside surface of the weighted implement body 30, the surface that makes contact with the golf club, is coated with a resilient material to form a large contact surface area. This large contact surface area minimizes the movement of the weighted implement relative to the golf club during practice swings.

Figure 8:
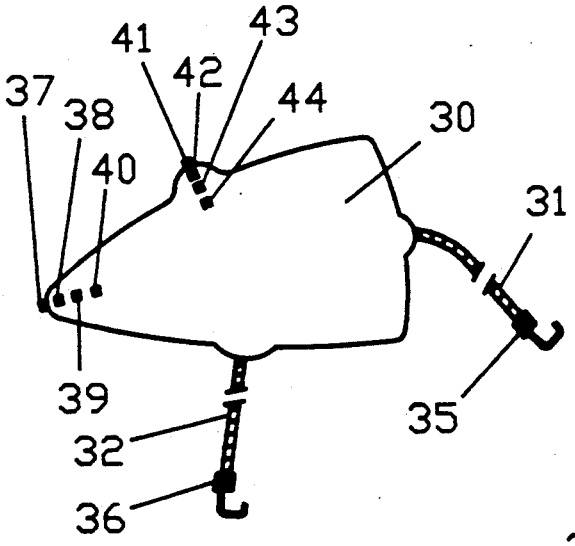
FIG. 8 is a view of the weighted implement as seen from the toe end of the conventional wood type golf club.

FIG. 8 is a view of the weighted implement as seen from the toe end of the conventional wood type golf club.

Figure 9:
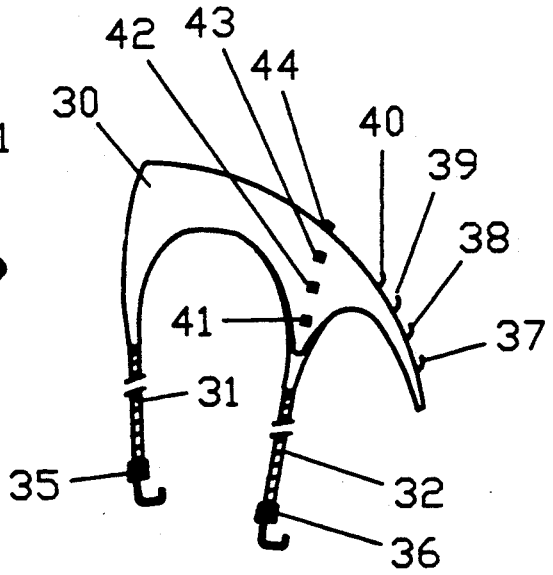
FIG. 9 is a view of the weighted implement as seen from above the conventional wood type golf club.

FIG. 9 is a view of the weighted implement as seen from above the conventional wood type golf club.

As discussed above, the considerations that contribute towards the attainment of the present invention's objective of providing a high axial moment of inertia training device are the location of the mass section center of gravity relative to the hosel centerline and the weight of the mass section. In FIG. 3, it is the distance 15 and the weight of the mass section 12 that is mainly controlling the torque about the hosel 10 centerline. In FIG. 5 and 6, it is the distance 25 and the combined weight of the mass section 22, bolt assembly 24, 26 and 27; and weights 28 and 29 that is mainly controlling the torque about the hosel 20 centerline.

While a preferred embodiment of the present invention has been shown for a particular design in the drawing and discussed herein, many modifications thereof may be made by a person skilled in the art without departing from the spirit and scope of the present invention.

For the purpose of the present invention:

A conventional golf club is defined as a golf ball striking implement used by the great majority of golfers, wherein said golf ball striking implement is comprised of a grip, a shaft, and a club head, wherein said club head is comprised of a body, wherein said body is comprised of at least a hosel and a toe extremity, wherein the hosel is the part that interfits with the shaft and the toe extremity is the part that is the farthest from the hosel. A straight shaft is defined as a shaft that is substantially straight from one end to the other end. A standard grip is defined as a grip that is substantially circular in cross-section, except that a continuous, straight, slightly raised rib may be incorporated along the full length of the grip, may be tapered but must not have any bulge or waist, and the axis of the grip must coincide with the axis of the shaft. The shaft longitudinal axis is identical to the hosel centerline.

What I claim is:

1. A golf swing training device comprising a standard grip, a straight shaft, and a training device head, having a weight limitation of not more than 19 ounces;

said standard grip being adhesively attached to said straight shaft;

said straight shaft being attached to said training device head;

said training device head weight being in the range of 8.0 to 14.0 ounces, being shaped to define a mass section, a hosel, and an interconnect joining the mass section to the hosel;

said mass section having a weight of at least 5.0 ounces;

said mass section having a front surface area of at least 2.0 square inches;

said mass section having center of gravity located at least 2.5 inches from the longitudinal axis of said straight shaft;

said mass section center of gravity location affording a high axial moment of inertia training device defined by having a torque limitation of not less than 17.5 in-oz about said longitudinal axis when said mass section has a weight of 7.0 ounces;

said torque limitation being adjusted by the dimensionless multiplying factor obtained by dividing the actual weight of said weighted mass section in ounces by 7.0 ounces;

said hosel being that portion of said training device head that is designed to interfit with said straight shaft;

said interconnect being a structural connection rigidly connecting said mass section to said hosel; and wherein said interconnect and said hosel have a combined weight limitation of not more than 3.0 ounces.

2. The golf swing training device of claim 1, wherein said training device head is coated with a resilient material.

3. The golf swing training device of claim 1, wherein said mass section having means to readily adjust the weight of said mass section; and wherein said training device head weight being adjustable over a range of from 8.0 to 14.0 ounces by adjustment of said weight of said mass section.

4. A training device head comprising a hosel, a mass section, and an interconnect joining the mass section to the hosel;

said hosel being that portion of said training device head that is designed to interfit with a golf club shaft;

said training device head weight being in the range of 8.0 to 14.0 ounces, said mass section having a weight of at least 5.0 ounces;

said mass section having a front surface area of at least 2.0 square inches;

said mass section having center of gravity located at least 2.5 inches from the hosel centerline;

said mass section center of gravity location affording a high axial moment of inertia training device defined by having a torque limitation of not less than 17.5 in-oz about said hosel centerline when said mass section has a weight of 7.0 ounces;

said torque limitation being adjusted by the dimensionless multiplying factor obtained by dividing the actual weight of said weighted mass section in ounces by 7.0 ounces;

said interconnect being a structural connection rigidly connecting said mass section to said hosel; and wherein said interconnect and said hosel having a combined weight limitation of not more than 3.0 ounces.

5. The training device head of claim 4, wherein said training device head is coated with a resilient material.

6. The training device head of claim 4, wherein said mass section having means to readily adjust the weight of said mass section; and wherein said training device head weight being adjustable over a range of from 8.0 to 14.0 ounces by adjustment of said weight of said mass section.

* * * * *